US012234709B2

(12) United States Patent
Fripp et al.

(10) Patent No.: US 12,234,709 B2
(45) Date of Patent: Feb. 25, 2025

(54) MAGNETIC INFLOW CONTROL DEVICE TO INHIBIT SCALE PRODUCTION IN A WELLBORE

(71) Applicant: Halliburton Energy Services, Inc., Houston, TX (US)

(72) Inventors: Michael Linley Fripp, Singapore (SG); Srividhya Sridhar, Houston, TX (US); Peter Reid Maher, Lafayette, LA (US)

(73) Assignee: Halliburton Energy Service, Inc., Houston, TX (US)

( * ) Notice: Subject to any disclaimer, the term of this patent is extended or adjusted under 35 U.S.C. 154(b) by 0 days.

(21) Appl. No.: 18/173,639

(22) Filed: Feb. 23, 2023

(65) Prior Publication Data

US 2024/0287880 A1 Aug. 29, 2024

(51) Int. Cl.
*E21B 43/12* (2006.01)

(52) U.S. Cl.
CPC ..... *E21B 43/12* (2013.01)

(58) Field of Classification Search
CPC ..... E21B 43/12
See application file for complete search history.

(56) References Cited

U.S. PATENT DOCUMENTS

| | | | | |
|---|---|---|---|---|
| 4,611,615 | A * | 9/1986 | Petrovic | F16L 55/24 210/695 |
| 2019/0195062 | A1* | 6/2019 | Espe | E21B 36/00 |
| 2021/0156235 | A1* | 5/2021 | Yin | E21B 33/12 |
| 2023/0392475 | A1* | 12/2023 | Marya | E21B 37/00 |

* cited by examiner

*Primary Examiner* — Giovanna Wright
(74) *Attorney, Agent, or Firm* — DeLizio, Peacock, Lewin & Guerra LLP

(57) ABSTRACT

An apparatus to be positioned in a wellbore formed in a subsurface formation. The apparatus comprises a flow control device to restrict a fluid flowing from the subsurface formation and into a tubular string positioned in the wellbore. The apparatus comprises a magnetic assembly positioned proximate the flow control device.

19 Claims, 9 Drawing Sheets

MAGNETIC INFLOW CONTROL DEVICE TO INHIBIT SCALE PRODUCTION IN A WELLBORE

FIELD

Embodiments of the inventive subject matter relate generally to the field of scale mitigation in hydrocarbon production from a wellbore and more particularly to the field of inhibiting scale production with a magnet.

BACKGROUND

Fluids produced from a subsurface formation may contain water. Ions dissolved in the water may come out of solution to form scale on wellbore equipment (such as tubing, flow control devices, etc.) as the water flows from the subsurface formation to the wellbore, and ultimately to the surface. As scale forms on downhole equipment, the scale may restrict and/or obstruct the flow path of the fluids flowing to the surface. The scale may also damage downhole equipment, leading to possible intervention operations. Often, it is desirable to inhibit the production of scale to avoid restricting the flow of the fluid produced from the subsurface formation and damaging downhole equipment. A magnet may be utilized to inhibit the production of scale. A very fast flow velocity has the potential to better inhibit the scale formation as fluid flows near the magnet. The challenge is how to increase the flow velocity to achieve greater scale inhibition without interfering with fluid production.

BRIEF DESCRIPTION OF THE DRAWINGS

Embodiments of the disclosure may be better understood by referencing the accompanying drawings.

DESCRIPTION

Figure 1:
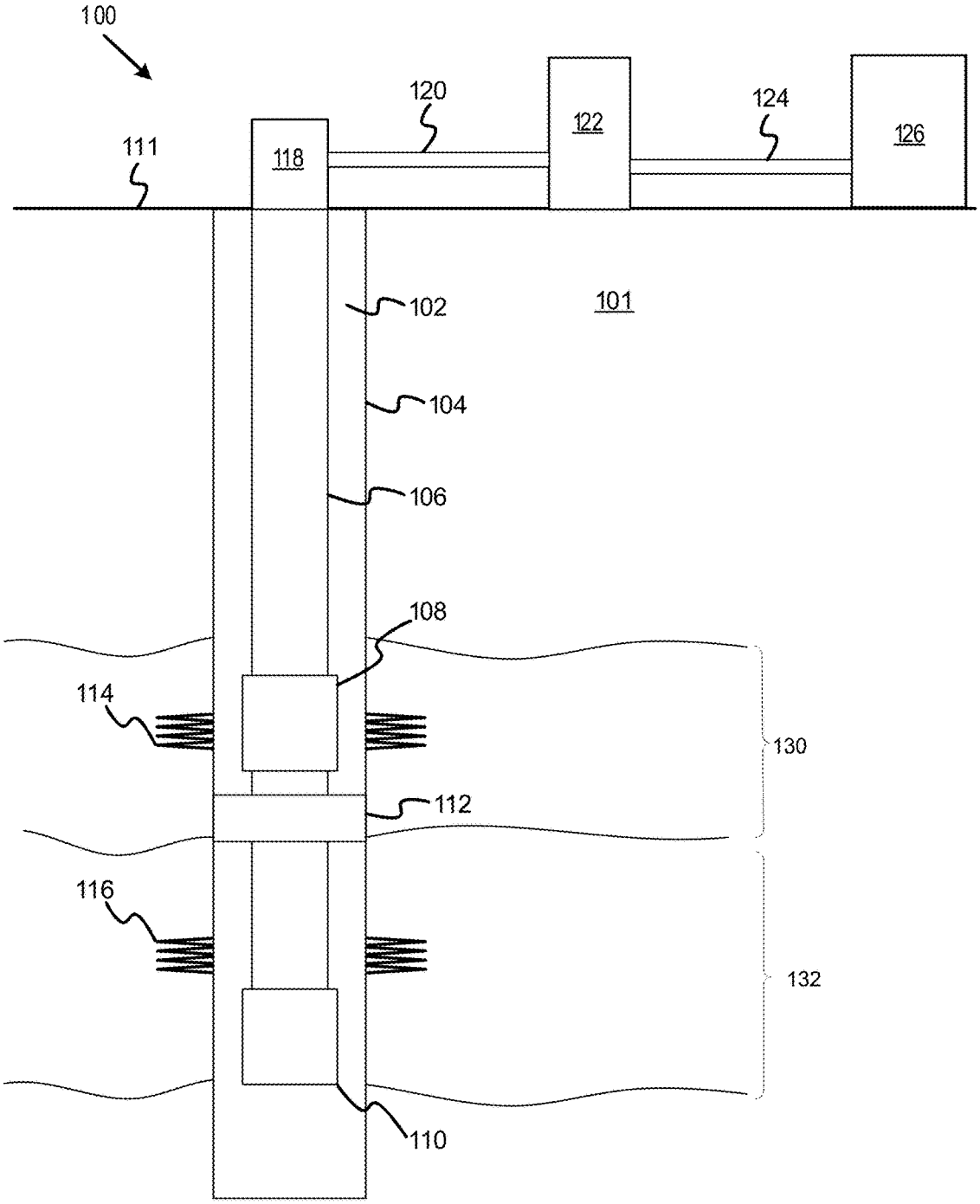
FIG. 1 depicts an example well system having a production tubing and at least one flow control device with a magnetic assembly positioned therein to inhibit scale production, according to some embodiments.

The description that follows includes example systems, methods, techniques, and program flows that embody aspects of the disclosure. However, it is understood that this disclosure may be practiced without these specific details. For instance, this disclosure refers to a magnet assembly positioned in a flow control device. Aspects of this disclosure can also be applied to any other configuration of a magnet assembly positioned in an inflow path of a tubular string. In other instances, well-known instruction instances, protocols, structures, and techniques have not been shown in detail in order not to obfuscate the description.

Example embodiments relate to inhibition of the production of scale in a tubular string positioned in a wellbore formed in a subsurface formation. In some embodiments, a flow control device may be positioned on the tubular string, such that fluid produced from the subsurface formation flows into the tubular string via the flow control device. In some embodiments, the flow control device may be configured with a flow restrictor that restricts the flow of fluid into the tubular string, thus increasing the flow velocity as the fluid flows through the flow control device. For example, the flow restrictor of a flow control device may include an inflow tube, a vortex, a fluidic diode, a nozzle, a Tesla valve, a fluidic oscillator, a static mixer, a steam valve, a puck, etc. In some embodiments, a magnet assembly may be positioned proximate the flow restrictor of a flow control device to inhibit the production of scale as fluid flows into the tubular string. For example, the magnet assembly may be positioned proximate a flow restrictor within an inflow control device (ICD), an autonomous inflow control device (AICD), an inflow control valve (ICV), etc. where the fluid flow restriction may result in an increase in the velocity of the fluid.

In some embodiments, the magnet assembly may include one or more magnets. In some embodiments, the magnet assembly may be configured to create an alternating magnetic field. The alternating magnetic field created by the magnet assembly may inhibit dissolved ions from coming out of solution (i.e., water from the subsurface formation) to form scale on equipment in the wellbore (such as the flow control device, the interior wall of the tubing, etc.). For instance, the dissolved ions in the fluid may have a charge. The charged, dissolved ions may encounter a magnetohydrodynamic force (e.g., a Lorentz force), generated by the alternating magnetic field, as the ions pass through the magnet assembly via the fluid flow. As a result, the dissolved ions may cluster in the flow of the fluid rather than attaching to the wellbore equipment, thus inhibiting the production of scale. For example, the magnetohydrodynamic force may encourage calcium carbonate ($CaCO3$) to form aragonite, which may not attach to the equipment or may attach with sufficiently low adhesion strength such that the flow friction may remove the aragonite. In some instances, a similar effect may occur when the precipitate includes calcium sulfate ($CaSO4$), barium sulfate ($BaSO4$), etc. In some embodiments, an increase in velocity and/or an increase in the alternating magnetic field may result in an increase in the magnetohydrodynamic force, thus improving the inhibition of scale production. Therefore, the magnet assembly may be positioned within a flow control device to utilize the high flow velocity of the fluid and increase the inhibition of scale production without interfering with the production of the fluid. By positioning the magnet assembly within a flow control device, the inhibition of scale production will be near the subsurface formation which may limit the locations in which scale may form.

Example Systems

FIG. 1 depicts an example well system having a production tubing and at least one flow control device with a magnetic assembly positioned therein to inhibit scale production, according to some embodiments. In particular, FIG. 1 is a schematic of a well system 100 that includes a wellbore 102 in a subsurface formation 101. The wellbore 102 includes casing 104 and number of perforations 114, 116 being made in the casing 104. Each set of perforations 114, 116 is located in a respective reservoir 130, 132 to allow reservoir fluids (i.e., oil, water, and gas) from the respective reservoirs 130, 132 to flow into the wellbore 102 and into the tubular string 106 (the production tubing). The tubular string 106 includes a packer 112 that may prevent the comingling of fluids produced from the reservoirs 130, 132 in the wellbore 102. A production assembly 108 may allow the inflow of fluid produced from the reservoir 130 into the tubular string 106. Likewise, a production assembly 110 may allow the inflow of fluid produced from the reservoir 132 into the tubular string 106.

The production assemblies 108, 110 may include flow control devices and a magnetic assembly positioned in each of the flow control devices to inhibit the production of scale from the water produced from the reservoirs 130, 132 (as further described below). The flow control devices may be configured with flow restrictors such as an inflow tube, a vortex, a fluidic diode, a nozzle, a Tesla valve, a fluidic oscillator, a static mixer, a steam valve, a puck, etc. to restrict flow as fluid flows into the tubular string 106. In some embodiments, the production assemblies 108, 110 may also include a screen.

A flowline 120 coupled to the wellhead 118 of wellbore 102 and a separator 122 may allow the fluid produced up the tubular string 106 to flow to the separator 122. The separator 22 may be designed to separate the phases of the fluid produced from the wellbore 102. For instance, oil, water, and gas may be separated from each other after passing through the separator 122. The aggregate of fluid produced from wellbore 102 may then flow to a tank battery, via flowline 124, that may include components such as storage tank 126, to store the produced fluid.

Figure 2:
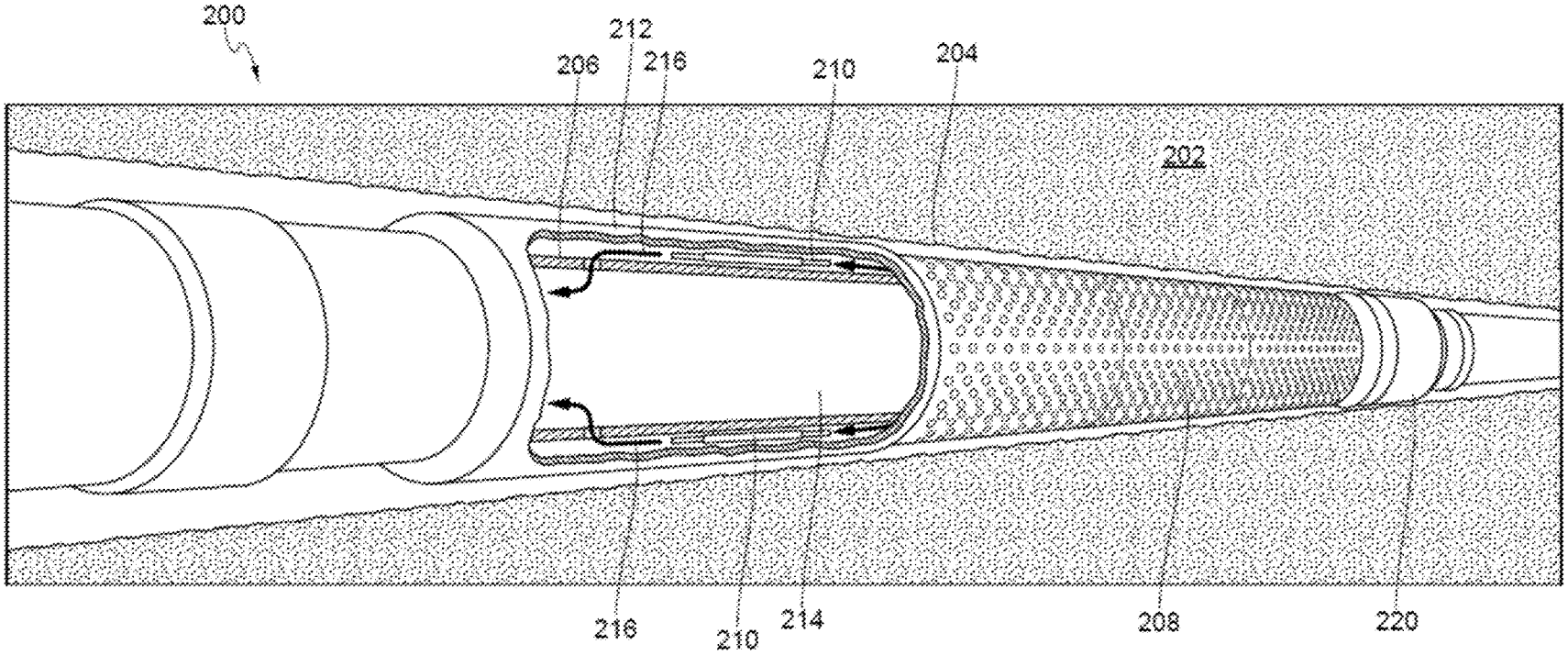
FIG. 2 depicts an example production assembly system, according to some embodiments.

FIG. 2 depicts an example production assembly system, according to some embodiments. In particular, FIG. 2 is a schematic of a production assembly 200 (such as production assemblies 108, 110 of FIG. 1) positioned on a tubular string 206 in a wellbore 204 in a subsurface formation 202. Formation fluid produced from the subsurface formation 202 may flow into the wellbore 204. To flow into the internal bore 214 of the tubular string 206, fluid may first flow through a screen 208 (i.e., a wire mesh screen enclosed in a perforated shroud). The fluid may then flow through an annular region 210 formed between the outer diameter of the tubular string 206 and a shroud 212, and into the internal bore 214 of the tubular string 206 via ports 216 on the tubular string 206. The annular region 210 may include a flow restrictor to increase the flow velocity of the fluid as it flows through the annular region 210. Additionally, a magnet assembly may be positioned proximate the annular region 210 to utilize the high flow velocity for inhibition of the production of scale as the fluid passed through the annular region 210. Alternatively, the magnet assembly may be positioned in the annular region 210 at a position that is either upstream or downstream of the of the flow restrictor. A packer 220 may be positioned on the tubular string 206 to isolate the fluids produced from a separate reservoir, as described in FIG. 1.

Example Magnet Assemblies

Examples of a magnet assembly are now described. Embodiments described herein include example flow restrictors of flow control devices where a magnet assembly may be positioned. For example, the example fluid control devices may be a part of production assemblies 108, 110 of FIG. 1.

Figure 3:
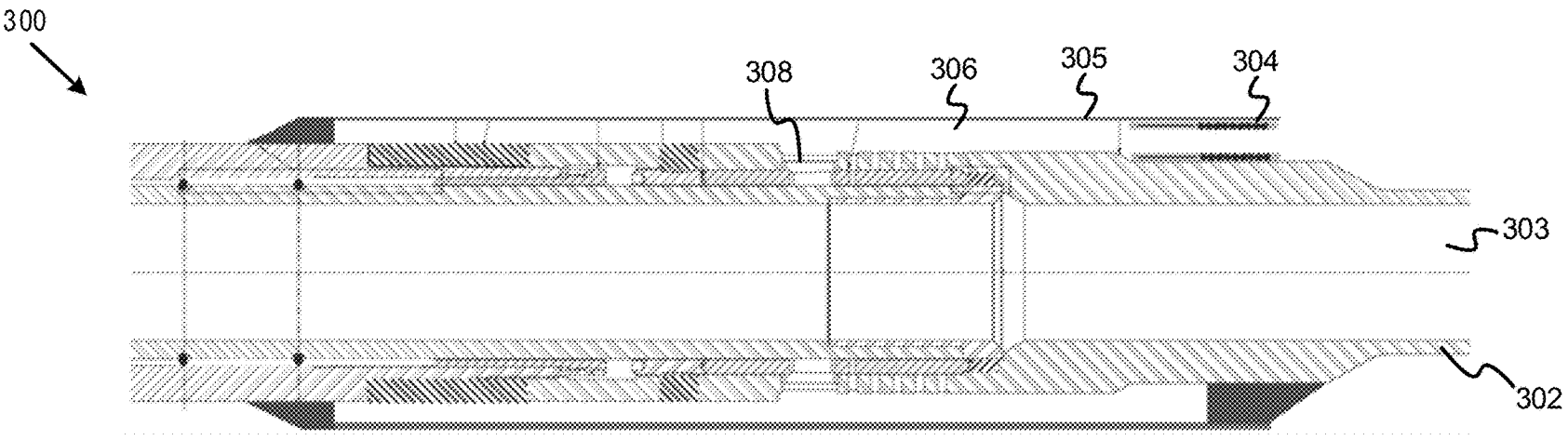
FIG. 3 depicts an example inflow control valve (ICV), according to some embodiments.
Figure 3:
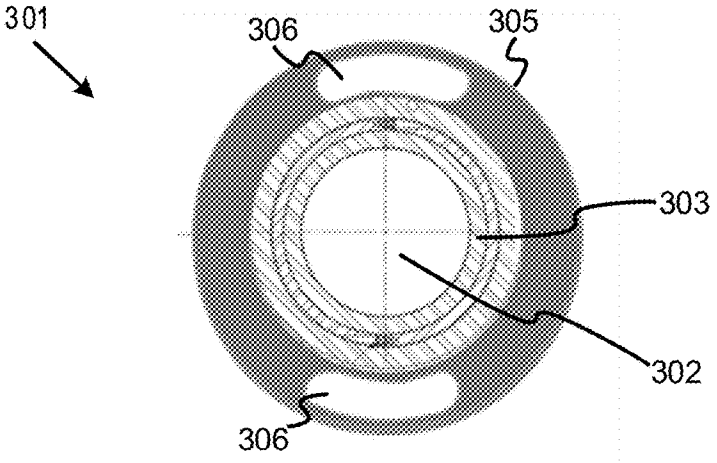

FIG. 3 depicts an example inflow control valve (ICV), according to some embodiments. In particular, FIG. 3 includes a schematic of an ICV 300 and a cross-sectional view 301 of ICV 300. ICV 300 includes a base pipe 302 with an internal bore 303. The ICV 300 may be positioned on a base pipe 302. A shroud 305 may be positioned external to the base pipe 302 to form inflow tubes 306 (i.e., a flow restrictor). Ports 308 may allow hydraulic communication between the inflow tubes 306 and the internal bore 303 such that fluid may flow from the inflow tubes 306 and into the internal bore 303. The inflow tubes 306 may be configured such that fluid flow is restricted when flowing from the subsurface formation and into the ICV 300, thus the flow velocity may increase as fluid flows from the wellbore and into the inflow tubes 306. For example, the cross-sectional area of the inflow tube 306 may be less than the cross-sectional area upstream of the inflow tubes 306 (i.e., where the fluid is flowing from, such as the wellbore), resulting in a restriction of the fluid flow and the flow velocity increasing when the fluid enters the inflow tubes 306. A magnet assembly 304 may be positioned proximate one or more of the inflow tubes 306 where there may be an increased flow velocity to maximize the magnetohydrodynamic force applied to the dissolved ions in the fluid, thus inhibiting the production of scale. In the embodiment shown in FIG. 3, the magnetic flux generated by the magnet assembly 304 may be contained within the inflow tube 306 and may not extend beyond the metal of the base pipe 302 and shroud 305. For instance, approximately all (i.e., at least 90%) of the magnetic flux may be contained within the walls of the ICV 300, between the shroud 305 and the base pipe 302 (i.e., a flow restrictor such as the inflow tube 306). For example, approximately none of the magnetic flux generated by the magnet assembly 304 (less than 10%) may extend into the internal bore 303 and/or outside the shroud 305 and into the wellbore.

Figure 4:
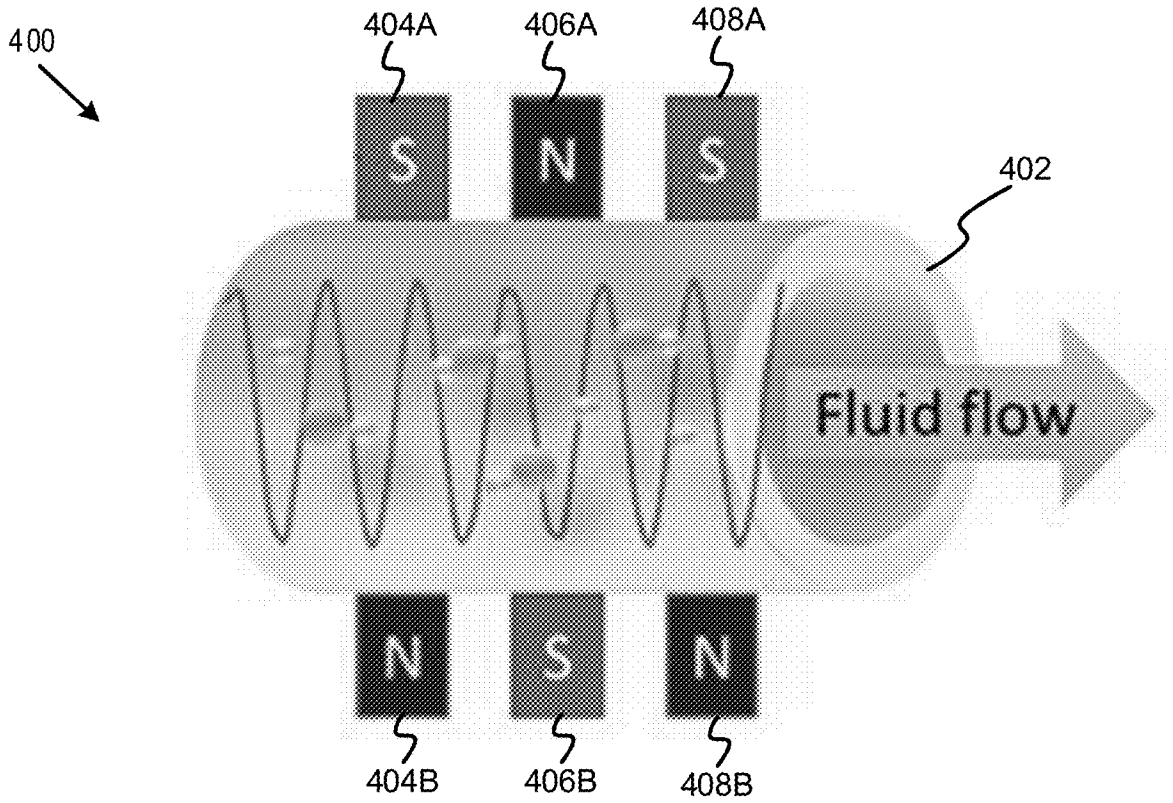
FIG. 4 depicts an example magnet assembly positioned on a flow restrictor, according to some embodiment.

To help illustrate, FIG. 4 depicts an example magnet assembly positioned on a flow restrictor, according to some embodiment. In particular, FIG. 4 includes a flow restrictor 400 that includes an inflow tube 402. The inflow tube 402 may be similar to the inflow tubes 306 of FIG. 3. In some embodiments, the inflow tube 402 may be a component of an inflow control device (ICD), such as a nozzle, that may create a pressure drop for balancing production. The flow restrictor 400 may comprise magnets 404A, B, 406A, B, and 408A, B positioned around the circumference of the inflow tube 402. In some embodiments, the magnets may be positioned upstream or downstream of the inflow tube 402. FIG. 4 depicts two rows of magnets, where the azimuthal position of magnets 404A, 406A, and 408A on the inflow tube 402 are approximately 180 degrees about the longitudinal axis of the inflow tube 402 from magnets 404B, 406B, and 408B. In some embodiments, the respective magnet pairs may have a relative azimuthal position greater than or less than 180 degrees. In some embodiments, the magnets along the flow path may flip the magnetic field as shown in FIG. 4 where the magnetic field direction of magnets 404A, B may be in approximately the opposite direction from the field direction of magnets 406A, B. In some embodiments, the magnets along the flow path may rotate the magnetic field such as if the field line from magnets 404A, B is approximately 90 degrees from the field lines from magnets 406A, B. In some embodiments, there may be only one row of magnets (e.g., the magnet assembly may only include magnets 404A, 406A, and 408A) that may be positioned approximately parallel to the longitudinal axis of the inflow tube 402. In some embodiments there may be more than two rows of magnets. In some embodiments, there may be only one row of magnets positioned approximately parallel to the longitudinal axis of the inflow tube 402 and a ferromagnetic component with an azimuthal position of approximately 180 degrees longitudinal from the row of magnets. In some embodiments, the magnet subsets (i.e., magnets 404A and 404B) may be arranged about the circumference of the inflow tube 402 in various arrays, as described below in FIG. 5. The magnets 404A, B, 406A, B, and 408A, B may be configured to generate an alternating magnetic field. For example, the configuration of magnet subset 404 A, B may be opposite of the configuration of magnet subset 406 A, B such that the magnet fields generated by each respective magnet subset are opposite each other. As fluid flows through the inflow tube 402 and the alternating magnetic field, the dissolved ions in the fluid may feel a Lorentz force (magnetohydrodynamic force) from the alternating magnetic field. In some embodiments, the magnetic field lines may be approximately perpendicular to the flow direction. In another embodiment, the magnetic field lines may be approximately parallel to the flow direction.

Figure 5:
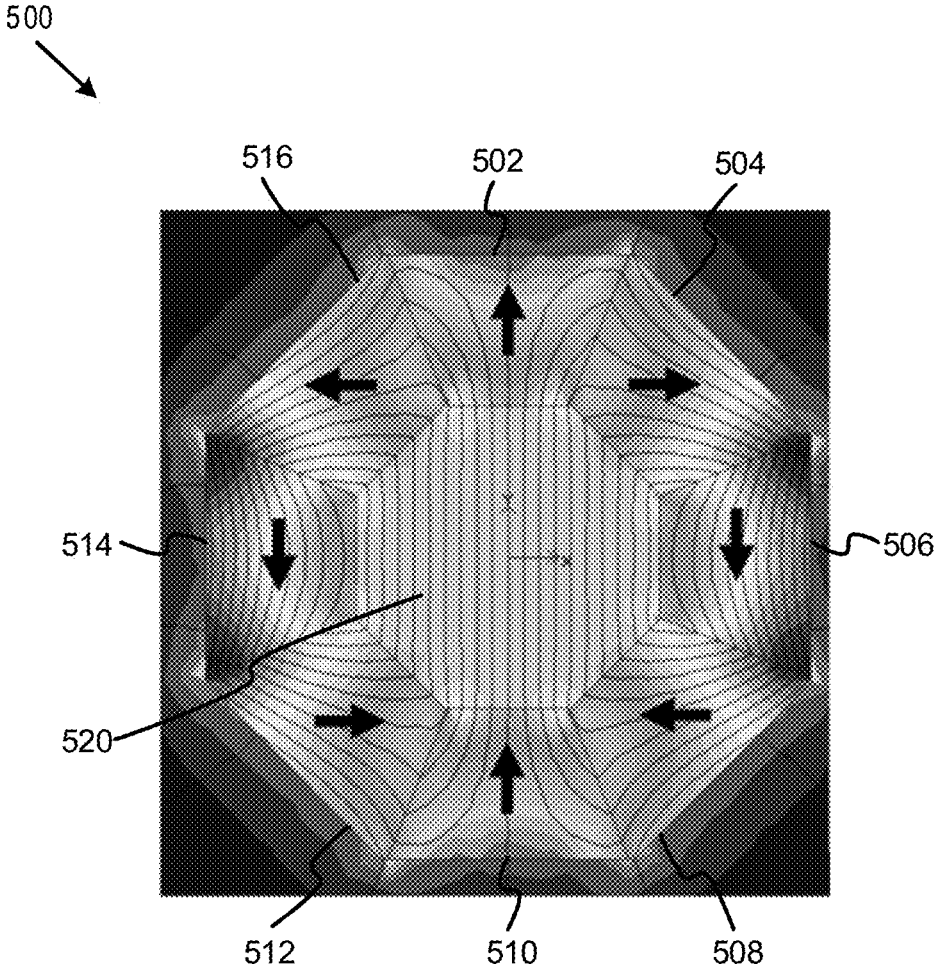
FIG. 5 depicts an example illustration of magnets in a Halbach array, according to some embodiments.

To further illustrate a magnet assembly configuration, FIG. 5 depicts an example illustration of magnets in a Halbach array, according to some embodiments. A magnet subset 500 (such as magnets 404A,B of FIG. 4) includes magnets 502-516 arranged in a Halbach array. The magnets 502-516 may be arranged in a Halbach array about the circumference of a flow restrictor of a flow control device. The arrows for each respective magnet 502-516 indicate the direction of the magnetic field for each magnet 502-516. The Halbach array may create an approximately uniform magnetic field within the interior area 520 (i.e., the flow restrictor). In some embodiments, there may be radial constraints within the inflow path of the flow restrictor that may allow for only a partial Halbach array. For example, magnets may not be placed around the entire circumference of the flow restrictor. In some embodiments, the Halbach array configuration may not be at least partially circular. For example, the Halbach array may be configured to be rectangular, in two parallel planes, etc.

Figure 6:
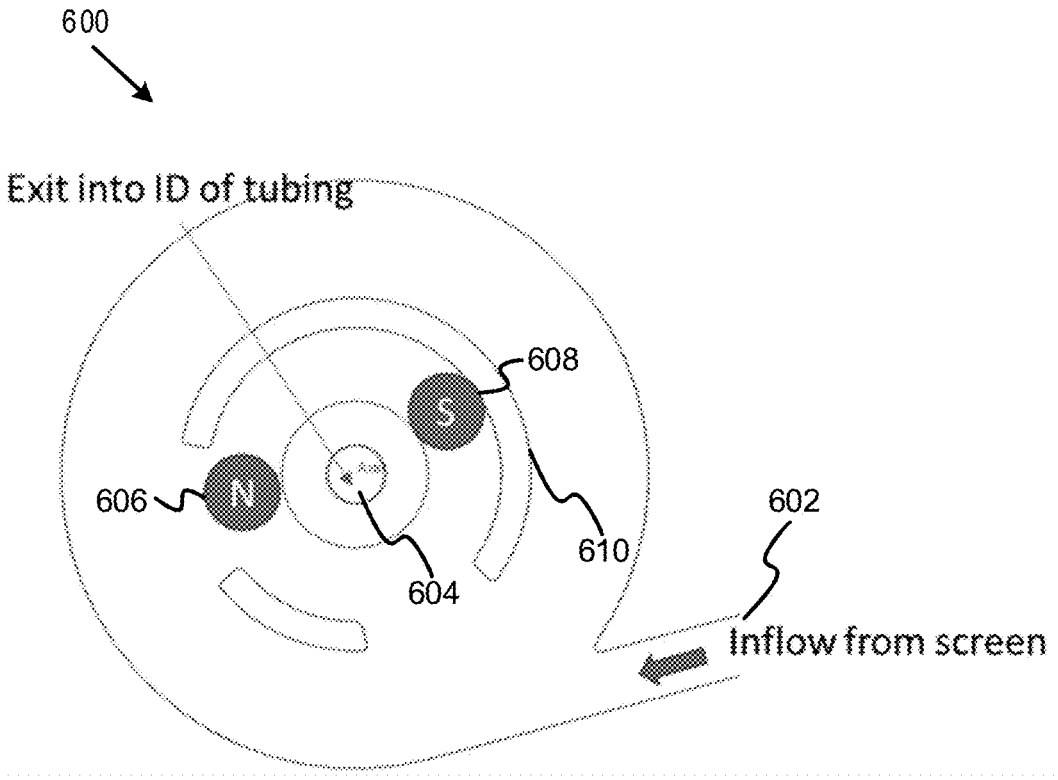
FIG. 6 depicts an example vortex, according to some embodiments.
Figure 7:
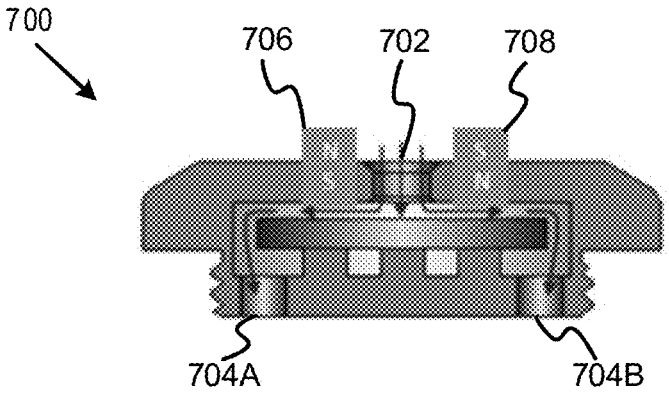
FIG. 7 depicts an example steam valve, according to some embodiments.
Figure 8:
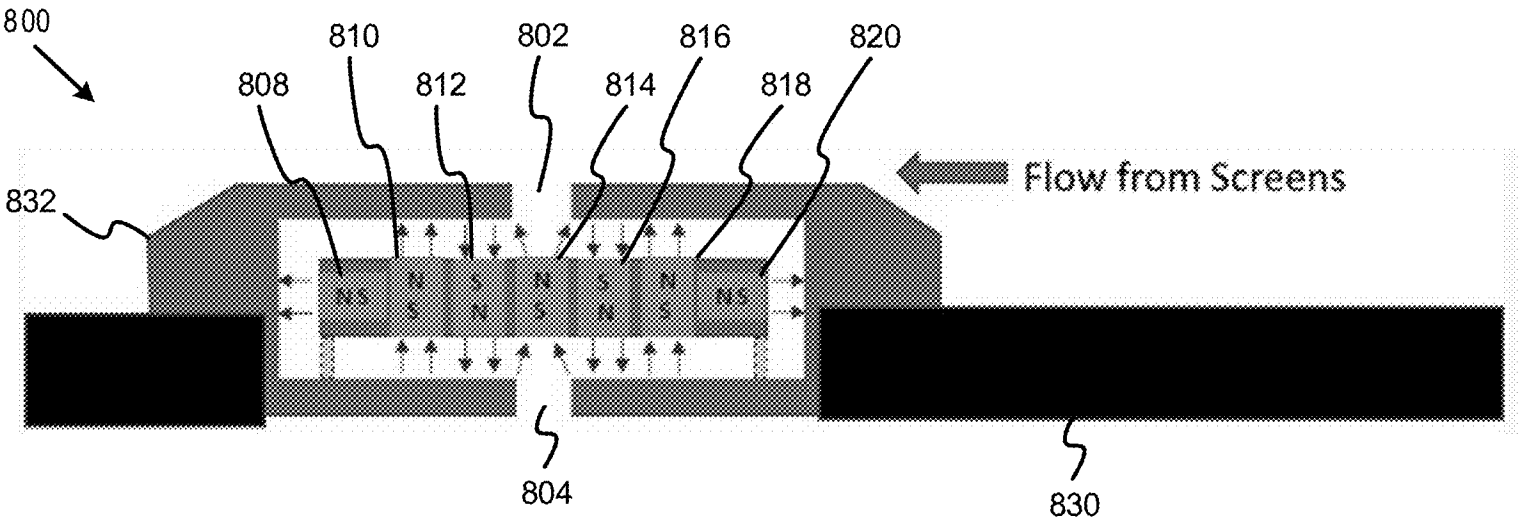
FIG. 8 depicts an example puck, according to some embodiments.

Example flow restrictors are now described in reference to FIGS. 6-8. FIG. 6 depicts an example vortex, according to some embodiments. In particular, FIG. 6 includes a vortex 600 with a fluid entry point 602, a fluid exit point 604, interior vanes 610, and a magnet assembly comprising magnets 606, 608 positioned proximate the fluid exit point 604. The vortex 600 may be positioned on a tubular string (such as a within a flow control device of production assemblies 108, 110 of FIG. 1), between a screen and the interior bore of the tubular string. As fluid enters the vortex 600 via the fluid entry point 602, the fluid may circulate about center axis of the vortex 600. As the fluid nears the fluid exit point 604, the flow velocity of the fluid increases. In some embodiments, the flow velocity may be approximately 150 meters/second (m/s). As the fluid circulates about the central axis of the vortex 600, the fluid may pass the magnets 606, 608 multiple times before it exits into the tubular string. As the fluid passes the magnets 606, 608, the fluid passes through the alternating magnetic field generated by the magnets 606, 608 to inhibit scale production before exiting into the interior bore of the tubular string through the fluid exit point 604.

FIG. 7 depicts an example steam valve, according to some embodiments. In particular, FIG. 7 includes a steam valve 700 with a fluid entry point 702, fluid exit points 704A, B, and a magnet assembly comprising magnets 706, 708. The steam valve 700 may be positioned on a tubular string (such as a within a flow control device of production assemblies 108, 110 of FIG. 1). As fluid enters the steam valve 700 through the fluid entry point 702, the fluid may pass through the alternating magnetic field generated by the magnets 706, 708 to inhibit scale production before exiting into the interior bore of the tubular string through the fluid exit points 704A, B. In some embodiments, alternating magnetic field may treat the fluid in the vertical section near the fluid entry point 702 or the horizontal section of the inflow path of the steam valve 700.

FIG. 8 depicts an example puck, according to some embodiments. In particular, FIG. 8 includes a puck 800 with a fluid entry point 802, fluid exit points 804, and a magnet assembly comprising magnets 808-820 positioned on a housing 832. In some embodiments, the magnets 808-820 may be arranged concentrically or non-concentrically. In some embodiments, the housing 832 may include ferromagnetic material. The puck 800 may be positioned on a tubular string 830 (such as a within a flow control device of production assemblies 108, 110 of FIG. 1). As fluid enters the puck 800 through the fluid entry point 802, the fluid may pass through the alternating magnetic field generated by the magnets 808-820 to inhibit scale production before exiting into the interior bore of the tubular string through the fluid exit point 804.

Example Operations

Example operations for inhibiting scale production are now described in reference to FIG. 3.

Figure 9:
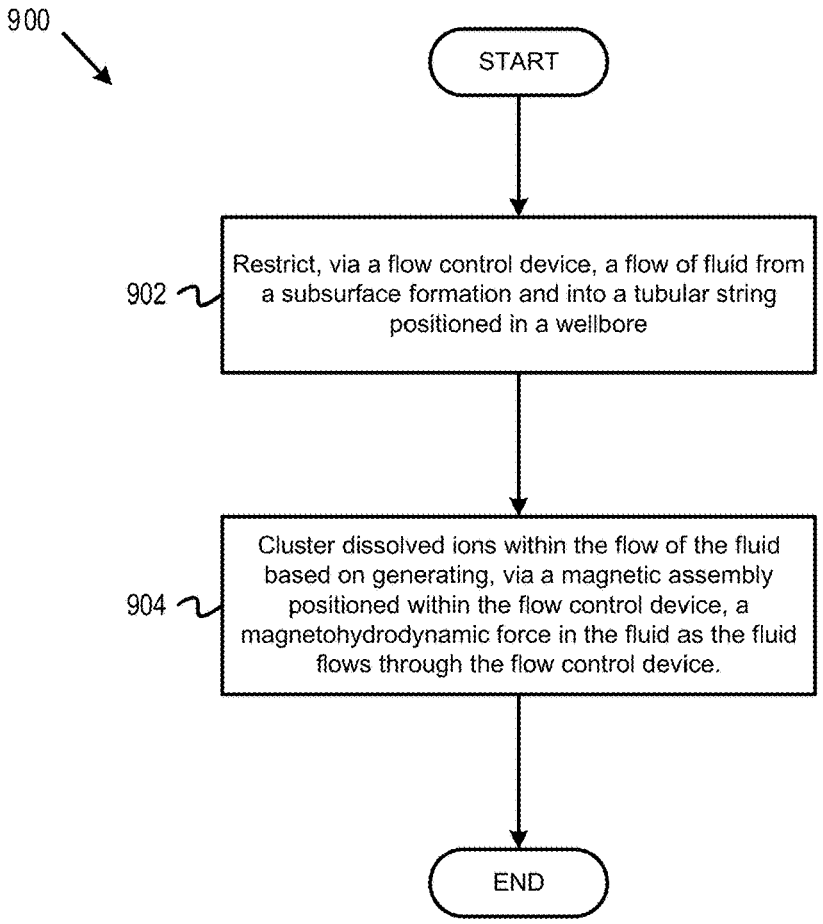
FIG. 9 depicts a flowchart of example operations for inhibiting scale production, according to some embodiments.

FIG. 9 depicts a flowchart of example operations for inhibiting scale production, according to some embodiments. FIG. 9 depicts a flowchart 900 of operations to inhibit scale production with a magnet assembly positioned on a flow control device. The operations of flowchart 900 are described in reference to flow control devices included in production assemblies 108, 110 of FIG. 1 and production assembly 200 of FIG. 2.

At block 902, a flow control device restricts a flow of fluid from a subsurface formation and into a tubular string positioned in a wellbore. In some embodiments, the flow control device may be configured with a fluid restrictor such as a nozzle, a vortex, a Tesla valve, a fluidic oscillator, a static mixer, and a steam valve, etc.

At block 904, dissolved ions are clustered within the flow of the fluid based on generating, via a magnetic assembly positioned within the flow control device, a magnetohydrodynamic force in the fluid as the fluid flows through the flow control device.

Example Embodiments

Embodiment #1: An apparatus to be positioned in a wellbore formed in a subsurface formation, the apparatus comprising: a flow control device to restrict a fluid flowing from the subsurface formation and into a tubular string positioned in the wellbore; and a magnetic assembly positioned proximate the flow control device.

Embodiment #2: The apparatus of Embodiment #1, wherein the flow control device is configured to increase a flow velocity of the fluid as the fluid flows through the flow control device, the flow control device comprising at least one of a nozzle, a vortex, a Tesla valve, a fluidic oscillator, a static mixer, and a steam valve.

Embodiment #3: The apparatus of Embodiments #1 or #2, wherein the magnetic assembly is to create a magnetic field through which the fluid is to flow.

Embodiment #4: The apparatus of Embodiment #3, wherein the magnetic field comprises an alternating magnetic field.

Embodiment #5: The apparatus of any one or more of Embodiments #1-4, wherein the magnetic assembly comprises multiple magnets.

Embodiment #6: The apparatus of Embodiment #5, wherein the multiple magnets are positioned proximate a flow restrictor of the flow control device.

Embodiment #7: The apparatus of Embodiment #6, wherein the multiple magnets are positioned around a circumference of the flow restrictor of the flow control device in at least a partial Halbach array.

Embodiment #8: The apparatus of any one or more of Embodiments #1-8, wherein the magnetic assembly is to generate a magnetohydrodynamic force in the fluid as the fluid flows through the flow control device.

Embodiment #9: The apparatus of Embodiment #8, wherein the fluid comprises dissolved ions that are to cluster in the fluid flow and not attach to at least one of a wall of the flow control device and an inner wall of the tubular string in response to the magnetohydrodynamic force.

Embodiment #10: A method comprising: restricting, via a flow control device, a flow of fluid from a subsurface formation and into a tubular string positioned in a wellbore; and clustering dissolved ions within the flow of the fluid based on generating, via a magnetic assembly positioned proximate the flow control device, a magnetohydrodynamic force in the fluid as the fluid flows through the flow control device.

Embodiment #11: The method of Embodiment #10, wherein generating the magnetohydrodynamic force comprises creating a magnetic field through which the fluid is to flow.

Embodiment #12: The method of Embodiment #11, wherein the magnetic field comprises an alternating magnetic field.

Embodiment #13: The method of any one or more of Embodiments #10-12, wherein the magnetic assembly comprises multiple magnets that are positioned proximate a flow restrictor of the flow control device.

Embodiment #14: The method of Embodiment #13, wherein the multiple magnets are positioned around a circumference of the flow restrictor the flow control device in at least a partial Halbach array.

Embodiment #15: A system comprising: a tubular string to be positioned in a wellbore formed in a subsurface formation; a flow control device to restrict a fluid flowing from the subsurface formation and into the tubular string positioned in the wellbore; and a magnetic assembly positioned proximate the flow control device.

Embodiment #16: The system of Embodiment #15, wherein the flow control device is configured to increase a flow velocity of the fluid as the fluid flows through the flow control device, the flow control device comprising at least one of a nozzle, a vortex, a Tesla valve, a fluidic oscillator, a static mixer, and a steam valve.

Embodiment #17: The system of Embodiments #15 or #16, wherein the magnetic assembly is to create a magnetic field through which the fluid is to flow, wherein the magnetic field comprises an alternating magnetic field.

Embodiment #18: The system of any one or more of Embodiments #15-17, wherein the magnetic assembly comprises multiple magnets that are positioned proximate a flow restrictor of the flow control device.

Embodiment #19: The system of Embodiment #18, wherein the multiple magnets are positioned around a circumference of the flow restrictor of the flow control device in at least a partial Halbach array.

Embodiment #20: The system of any one or more of Embodiments #15-19, wherein the magnetic assembly is to generate a magnetohydrodynamic force in the fluid as the fluid flows through the flow control device.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

The invention claimed is:

1. An apparatus to be positioned in a wellbore formed in a subsurface formation, the apparatus comprising:

a flow control device to restrict a fluid flowing from the subsurface formation and into a tubular string positioned in the wellbore, wherein the flow control device is configured with one or more flow restrictors to increase a flow velocity of the fluid as the fluid flows through the flow control device; and a magnetic assembly positioned at least partially around a circumference of a flow path downstream of an entrance of the one or more flow restrictors where the flow velocity is increased and configured to generate a magnetohydrodynamic force in the fluid as the fluid flows through the flow control device.

2. The apparatus of claim 1, wherein the one or more flow restrictors comprises at least one of a nozzle, a vortex, a Tesla valve, a fluidic oscillator, a static mixer, and a steam valve.

3. The apparatus of claim 1, wherein the magnetic assembly is to create a magnetic field through which the fluid is to flow.

4. The apparatus of claim 3, wherein the magnetic field comprises an alternating magnetic field.

5. The apparatus of claim 1, wherein the magnetic assembly comprises multiple magnets.

6. The apparatus of claim 5, wherein the multiple magnets are positioned proximate the one or more flow restrictors of the flow control device.

7. The apparatus of claim 6, wherein the multiple magnets are positioned around the circumference of the one or more flow restrictors of the flow control device in at least a partial Halbach array.

8. The apparatus of claim 1, wherein the fluid comprises dissolved ions that are to cluster in the fluid flow and not attach to at least one of a wall of the flow control device and an inner wall of the tubular string in response to the magnetohydrodynamic force.

9. The apparatus of claim 1, wherein the magnetic assembly is positioned in a the flow path upstream of an exit from the one or more flow restrictors.

10. A method comprising:

restricting, via a flow control device, a flow of fluid from a subsurface formation and into a tubular string positioned in a wellbore, wherein the flow control device is configured with one or more flow restrictors to increase a flow velocity of the fluid as the fluid flows through the flow control device; and clustering dissolved ions within the flow of the fluid based on generating, via a magnetic assembly positioned at least partially around a circumference of a flow path downstream of an entrance of the one or more flow restrictors where the flow velocity is increased, a magnetohydrodynamic force in the fluid as the fluid flows through the flow control device.

11. The method of claim 10, wherein generating the magnetohydrodynamic force comprises creating a magnetic field through which the fluid is to flow.

12. The method of claim 11, wherein the magnetic field comprises an alternating magnetic field.

13. The method of claim 10, wherein the magnetic assembly comprises multiple magnets that are positioned proximate the one or more flow restrictors of the flow control device.

14. The method of claim 13, wherein the multiple magnets are positioned around a circumference of the one or more flow restrictors the flow control device in at least a partial Halbach array.

15. A system comprising:

a tubular string to be positioned in a wellbore formed in a subsurface formation;

a flow control device to restrict a fluid flowing from the subsurface formation and into the tubular string positioned in the wellbore, wherein the flow control device is configured with one or more flow restrictors to increase a flow velocity of the fluid as the fluid flows through the flow control device; and a magnetic assembly positioned at least partially around a circumference of a flow path downstream of an entrance of the one or more flow restrictors where the flow velocity is increased and configured to generate a magnetohydrodynamic force in the fluid as the fluid flows through the flow control device.

16. The system of claim 15, wherein the one or more flow restrictors comprises at least one of a nozzle, a vortex, a Tesla valve, a fluidic oscillator, a static mixer, and a steam valve.

17. The system of claim 15, wherein the magnetic assembly is to create a magnetic field through which the fluid is to flow, wherein the magnetic field comprises an alternating magnetic field.

18. The system of claim 15, wherein the magnetic assembly comprises multiple magnets that are positioned proximate the one or more flow restrictors of the flow control device.

19. The system of claim 18, wherein the multiple magnets are positioned around a circumference of the one or more flow restrictors of the flow control device in at least a partial Halbach array.

* * * * *